US010403994B2

(12) United States Patent
Best

(10) Patent No.: US 10,403,994 B2
(45) Date of Patent: Sep. 3, 2019

(54) ELECTRICAL PLUG-IN CONNECTOR FOR FORMING A PRINTED CIRCUIT BOARD CONNECTOR ON A PRINTED CIRCUIT BOARD

(71) Applicant: Phoenix Contact GmbH & Co. KG, Blomberg (DE)

(72) Inventor: Frank Best, Bueckeburg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/106,022

(22) Filed: Aug. 21, 2018

(65) Prior Publication Data

US 2019/0058272 A1 Feb. 21, 2019

(30) Foreign Application Priority Data

Aug. 21, 2017 (BE) ..... 2017/5573

(51) Int. Cl.
*H01R 24/00* (2011.01)
*H01R 12/72* (2011.01)
(Continued)

(52) U.S. Cl.
CPC ..... *H01R 12/727* (2013.01); *H01R 12/515* (2013.01); *H01R 12/724* (2013.01);
(Continued)

(58) Field of Classification Search
CPC .. H01R 12/727; H01R 12/515; H01R 12/724; H01R 13/11; H01R 13/50; H01R 13/502; H01R 13/514
(Continued)

(56) References Cited

U.S. PATENT DOCUMENTS 4,469,387 A * 9/1984 McHugh ..... H01R 12/716 439/140
4,583,807 A * 4/1986 Kaufman ..... H01R 12/724 439/573
(Continued)

FOREIGN PATENT DOCUMENTS

DE 202006016424 U1 1/2007
DE 602005003405 T2 9/2008
(Continued)

*Primary Examiner* — Abdullah A Riyami
*Assistant Examiner* — Vladimir Imas
(74) *Attorney, Agent, or Firm* — Leydig, Voit & Mayer, Ltd.

(57) ABSTRACT

An electrical plug-in connector for forming a printed circuit board connector on a printed circuit board includes: a housing body which, when in use, overlaps a printed circuit board contact side on an upper face or lower face of the printed circuit board vis-à-vis a housing portion and includes a plug-in connection side, for a mating plug-in connector, at an angle to the printed circuit board contact side; and an electrical connector element being accommodated in the housing body, which element provides, on the printed circuit board contact side, a first contact portion for contacting a conducting track of the printed circuit board and, on the plug-in connection side, a second contact portion for contacting a mating contact of the mating plug-in connector. The connector element is formed from a punched sheet-metal part such that a center of gravity of the electrical plug-in connector is arranged within the housing portion.

13 Claims, 4 Drawing Sheets

(51) Int. Cl.

| | |
|---|---|
| ***H01R 12/51*** | (2011.01) |
| ***H01R 13/11*** | (2006.01) |
| ***H01R 13/50*** | (2006.01) |
| ***H01R 13/502*** | (2006.01) |
| ***H01R 13/514*** | (2006.01) |

(52) U.S. Cl.
CPC ..... *H01R 13/11* (2013.01); *H01R 13/50* (2013.01); *H01R 13/502* (2013.01); *H01R 13/514* (2013.01)

(58) Field of Classification Search
USPC ..... 439/626
See application file for complete search history.

(56) References Cited

U.S. PATENT DOCUMENTS 4,652,066 A * 3/1987 Pelzl ..... H01R 12/727 439/78
5,004,430 A * 4/1991 DelGuidice ..... H01R 13/745 439/350
5,037,327 A * 8/1991 Van Woensel ..... H01R 12/727 439/571
5,158,470 A * 10/1992 Zarreii ..... H01R 12/58 439/751
5,167,531 A * 12/1992 Broschard, III ..... H01R 13/658 439/541.5
5,186,633 A * 2/1993 Mosser, III ..... H01R 12/57 439/79
5,385,489 A * 1/1995 Schell ..... H01R 12/716 439/571
5,478,260 A * 12/1995 Kaufman ..... G06K 7/0047 439/607.31
5,540,598 A * 7/1996 Davis ..... H01R 12/724 439/79
5,580,269 A * 12/1996 Fan ..... H01R 12/716 439/79
5,616,035 A * 4/1997 Shu ..... H01R 12/724 439/572
5,733,142 A * 3/1998 Clark ..... H01R 12/722 439/567
5,975,917 A * 11/1999 Wang ..... H01R 43/20 29/884
6,190,210 B1 * 2/2001 Belopolsky ..... H01R 12/7005 439/676
6,514,103 B2 * 2/2003 Pape ..... H01R 12/727 439/607.01
6,666,714 B1 * 12/2003 Li ..... H01R 13/447 439/149
7,153,147 B2 * 12/2006 Li ..... H01R 43/205 439/135
7,160,141 B2 * 1/2007 Marshall ..... H01R 12/73 439/451
7,255,601 B2 * 8/2007 Harper, Jr. ..... H01R 13/502 439/607.07
7,326,063 B1 * 2/2008 Raudenbush ..... H01R 4/64 439/581
7,351,097 B2 * 4/2008 Hsu ..... H01R 13/41 439/540.1
7,390,199 B2 * 6/2008 Honda ..... H01R 12/57 439/78
7,393,251 B2 7/2008 Sakamaki et al.
7,833,026 B1 * 11/2010 Morgan ..... H01R 12/52 439/108
7,980,896 B1 * 7/2011 Morgan ..... H01R 12/724 439/108
8,403,683 B2 * 3/2013 Yao ..... H01R 13/506 439/79
8,435,052 B2 * 5/2013 Potters ..... H01R 12/57 439/80
8,944,841 B2 * 2/2015 YuQiang ..... H01R 13/64 439/378
9,004,944 B2 * 4/2015 Annequin ..... H01R 12/724 439/607.13
9,022,796 B2 * 5/2015 Henzler ..... H01R 12/58 439/345
9,054,470 B2 * 6/2015 YuQiang ..... H01R 27/02
9,246,250 B2 * 1/2016 Yoshiura ..... H01R 12/707
9,502,809 B2 * 11/2016 Komiyama ..... H01R 12/722
2002/0102883 A1 8/2002 Mithuhashi et al.
2003/0166348 A1 * 9/2003 Martin ..... H01R 12/724 439/79
2008/0102712 A1 5/2008 Giefers
2015/0295342 A1 10/2015 Komiyama

FOREIGN PATENT DOCUMENTS

EP 0874421 A1 10/1998
EP 2955791 A1 12/2015

* cited by examiner

ELECTRICAL PLUG-IN CONNECTOR FOR FORMING A PRINTED CIRCUIT BOARD CONNECTOR ON A PRINTED CIRCUIT BOARD

CROSS-REFERENCE TO PRIOR APPLICATION

Priority is claimed to Belgian Patent Application No. BE2017/5573, filed on Aug. 21, 2017, the entire disclosure of which is hereby incorporated by reference herein.

FIELD

The invention relates to an electrical plug-in connector for forming a printed circuit board connector on a printed circuit board, and to a printed circuit board.

BACKGROUND

Electrical plug-in connectors of the type in question are for example generally known, for example, from DE 20 2006 016424 U1, and are provided with a housing body, a housing portion of which, in an assembled state, is arranged on an upper face or lower face of the printed circuit board so as to form a printed circuit board connector at this location. For this purpose, an electrical connector element is accommodated in the housing body, which element comprises, on a printed circuit board contact side, a first contact portion for electrically contacting the printed circuit board, in particular a conductor track of the printed circuit board. Furthermore, the electrical connector element provides, on a plug-in connection side at an angle to the printed circuit board contact side, a second contact portion for electrically contacting a mating contact of a contact carrier, in particular a mating plug-in connector, to be able to electrically connect the printed circuit board, by means of the electrical plug-in connector, to a contact carrier arranged thereon.

Contact carriers of this kind may be formed, for example, by plugs, couplings, sockets, etc., as mating plug-in connectors that comprise a contact or a plurality of electrical contacts that are accordingly formed as a mating contact for the second contact portion of the electrical connector element or of a plurality of electrical connector elements, for example and in particular at least in portions so as to complement the second contact portion of the electrical connector element in question.

Plug-in connectors, including those of the type in question, pose the challenge of connecting the electrical plug-in connector, initially loosely arranged on the printed circuit board, to the printed circuit board, in particular integrally, in the intended position. In the process, the problem often arises that the electrical plug-in connector has a tendency to tilt, and the tilting of the electrical plug-in connector therefore leads at least to the position of the electrical plug-in connector deviating from the intended position on the printed circuit board and thus makes connection to the printed circuit board difficult.

SUMMARY

In an embodiment, the present invention provides an electrical plug-in connector for forming a printed circuit board connector on a printed circuit board, comprising: a housing body which, when in use, overlaps a printed circuit board contact side on an upper face or lower face of the printed circuit board vis-à-vis a housing portion and comprises a plug-in connection side, configured for a mating plug-in connector, at an angle to the printed circuit board contact side; and an electrical connector element being accommodated in the housing body, which element provides, on the printed circuit board contact side, a first contact portion configured to contact a conducting track of the printed circuit board and, on the plug-in connection side, a second contact portion configured to contact a mating contact of the mating plug-in connector, wherein the connector element comprises a punched sheet-metal part such that a center of gravity of the electrical plug-in connector is arranged within the housing portion of the housing body due to the connector element being accommodated in the housing body.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
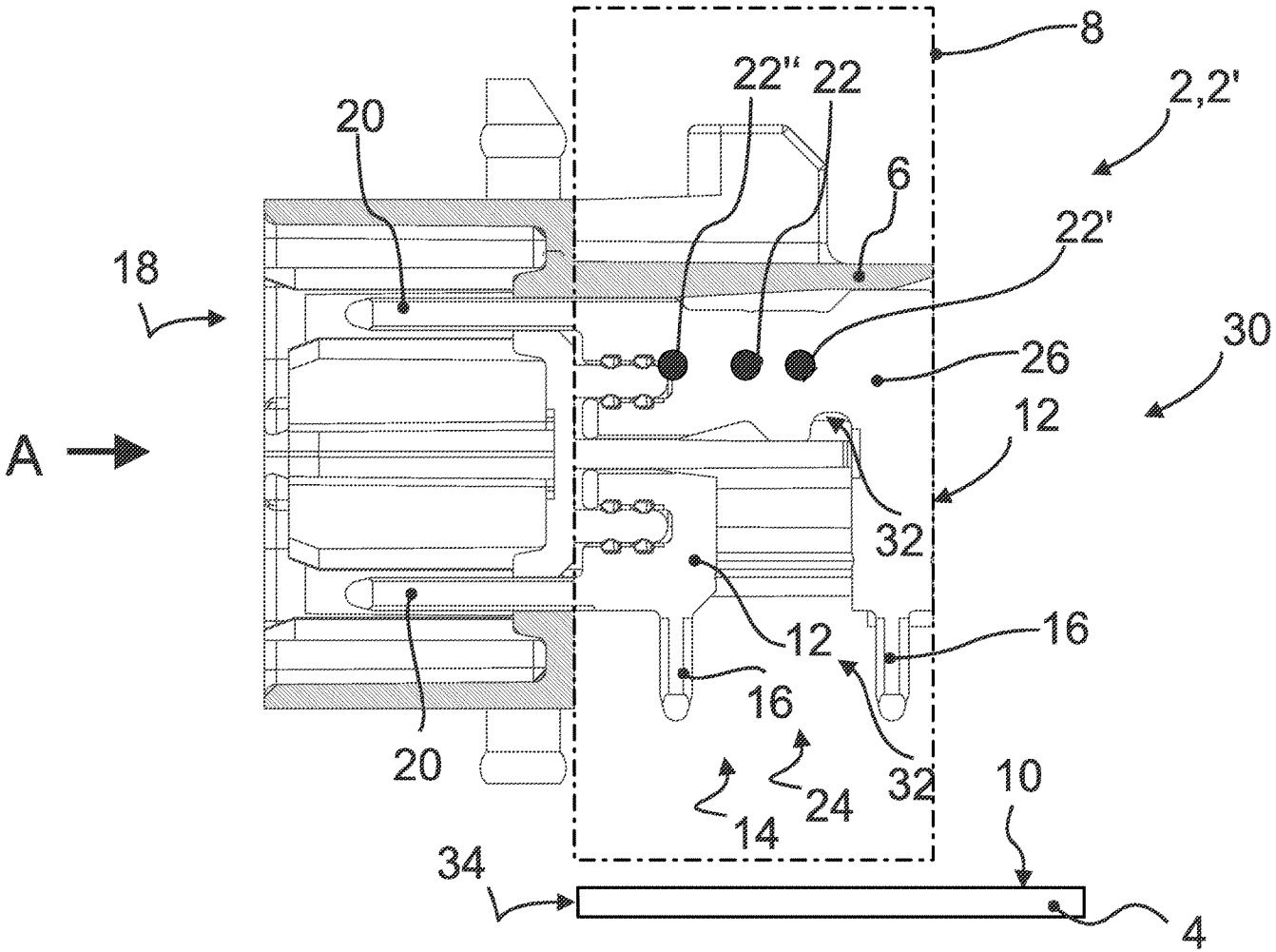
FIG. 1 is schematic, sectional side view of an embodiment of an electrical plug-in connector according to the invention.

The invention moves away from the concept of achieving a solution using supporting bodies, by means of which the electrical plug-in connector can be at least temporarily supported such that it can be connected to the printed circuit board. In addition, the invention moves away from the concept of achieving a solution using handling devices that hold the electrical plug-in connector when it is being connected to the printed circuit board.

The invention instead solves the problem it addresses by design measures for the electrical connector element making it possible to move the center of gravity of the housing body, together with the electrical connector element accommodated therein, so as to achieve positional stability.

The invention therefore also eliminates the risk of the electrical plug-in connector tilting in its arrangement on a printed circuit board to an effective degree and in a simple manner; as a result, positional stabilization of the electrical plug-in connector is achieved when arranged on a printed circuit board.

The invention achieves the above-described positional stabilization by skillfully superimposing the centers of gravity of the electrical connector element and the housing body; as a result, the resultant center of gravity is in a region in which it prevents the plug-in connector from tilting.

Within the scope of the invention, the term "center of gravity" refers to the center of mass.

The electrical connector element is formed of a punched sheet-metal part and is arranged on the housing body such that the center of gravity formed by the housing body, together with the electrical connector element accommodated therein, is within the housing portion by means of which, in the assembled state, the electrical plug-in connector is arranged on the printed circuit board in order to connect the electrical plug-in connector to the printed circuit board, in particular integrally. According to the invention, the punched sheet-metal part may also be deformed and have surface textures.

Within the scope of the invention, an assembled state is therefore defined by the electrical plug-in connector being arranged on the printed circuit board for the purpose of an, in particular integral, interconnection between the electrical plug-in connector and the printed circuit board so as to form the printed circuit board connector on the printed circuit board.

According to the invention, the housing portion is that by means of which, in the assembled state, the electrical plug-in connector is arranged on the printed circuit board and which rests on the printed circuit board by means of a resting surface that faces the printed circuit board in the assembled state.

The invention leads to the advantage that both an electrical plug-in connector and a printed circuit board according to the invention produce an electrical printed circuit board connector in a cost-effective manner. In addition, no additional aids are required, thus in turn resulting in handling advantages that lead to time savings.

To achieve a compact design, the concentration of mass within the housing portion has to be positioned accordingly. For this purpose, in an advantageous development of the invention the center of gravity of the connector element faces away from the second contact portion of the connector element, in particular faces the first contact portion of the connector element.

The invention displays its advantages in particular if the second contact portion of the electrical connector element projects beyond the housing portion at least in portions, as in an advantageous development of the invention, such that it is possible to achieve as compact as possible a design of a plug-in connector according to the invention or of a printed circuit board according to the invention.

To be able to make optimum use of the area of a printed circuit board for the arrangement of electrical/electronic components, or to keep the printed circuit board compact in terms of its dimensions, in a further advantageous development of the invention the second contact portion of the electrical connector element projects beyond an edge of the printed circuit board at least in portions in the assembled state. The printed circuit board is delimited by its edge, and the usable area of the printed circuit board is thus enlarged according to the invention.

Within the scope of the invention, the first contact portion and/or the second contact portion may be designed so as to complement a contact of the mating plug-in connector and be designed and formed, for example, in the manner of a socket or a tab contact. A further embodiment according to the invention helps to provide further positional stabilization by the first contact portion and/or the second contact portion of the at least one electrical connector element each being designed as a pin contact, meaning that a pin-contact-type design is also included. The design as a pin contact and a pin-contact-type design help to provide advantageous mass distribution and to prevent tilting.

The desired positional stabilization may be achieved in various ways. Particularly advantageously, in a corresponding development of the invention the first contact portion and the second contact portion of the at least one electrical connector element are interconnected by means of a sheet-like intermediate portion. In this case, the invention also includes the first contact portion and the second contact portion being integrally formed on a sheet-like intermediate portion and the electrical connector element therefore preferably being formed in one piece. In addition to simple adjustment of the weight distribution of the resultant center of gravity, this results in handling advantages. Furthermore, it is now possible to use one electrical connector element for various electrical plug-in connectors by adjusting the mass of the sheet-like intermediate portion. The mass can be adjusted, for example, by means of recesses/holes, which can be formed/adjusted accordingly in a simple manner, e.g. by forming one or more bores. According to the invention, the sheet-like intermediate portion is larger in terms of area than each of the first and the second contact portions of the electrical connector element, said intermediate portion being arranged for example and in particular within the housing portion; as a result, the housing body can in turn be kept compact in terms of its dimensions.

To facilitate simple assembly, in a further advantageous development of the invention the at least one electrical connector element is inserted into the housing body via a side opening that is formed for example and in particular on the printed circuit board contact side or the plug-in connection side, as well as on a side of the housing body opposite the printed circuit board contact side or the plug-in connection side. This advantageously simplifies the arrangement of the electrical plug-in connector element in the housing body of an electrical plug-in connector according to the invention. Furthermore, this makes it possible to integrate all the electrical connector elements, if there is a plurality thereof, into the housing body at the same time, thus resulting in advantages of economy, inter alia.

In an advantageous development of the design of a plug-in connector according to the invention or a printed circuit board according to the invention, for a secure mechanical and electrical connection the first contact portion of the at least one electrical connector element is designed and formed for integral connection to the printed circuit board, said portion being integrally connected to the printed circuit board, in particular by means of a soldered connection, in the connected state.

Within the scope of the invention, a connection state is distinguished in that the electrical plug-in connector is arranged on the printed circuit board and the at least one electrical connector element or the plurality of electrical connector elements, or one of said plurality, is connected to the printed circuit board, in particular integrally.

To facilitate a compact design of a plug-in connector according to the invention or a printed circuit board according to the invention, in a further advantageous development of the invention a plurality of electrical connector elements are accommodated in the housing body. In this case, the invention allows the overall center of gravity of the plurality of electrical connector elements to be arranged within the housing portion.

In this case, a compact design is also facilitated in that the plurality of electrical connector elements are arranged on the housing body in a row-and-column arrangement in a manner mutually spaced, as in a further advantageous development of the design of a plug-in connector according to the invention or a printed circuit board according to the invention.

The invention displays particular advantages in the case of a design as an SMD component, as in a further advantageous development of the invention. SMD is an abbreviation of "surface-mount device", SMD components being arranged on a printed circuit board by means of surface-mounting technology (SMT). Both SMD and SMT are specialist terms that are familiar to a person skilled in the relevant art and therefore do not need further explanation.

The advantage arises that the surface mounting does not require special measures to prevent a plug-in connector according to the invention from tilting. This in turn results in time and cost advantages.

The invention will be described below in more detail with reference to the accompanying drawings, in which an embodiment of a plug-in connector according to the invention is shown so as to represent a plurality of electrical plug-in connectors according to the invention; a printed circuit board according to the invention is also described on the basis of said plug-in connector.

In this description, all the features that are claimed, described and shown in the drawings form the subject matter of the invention, both in isolation and in combination, irrespective of the summary of said features in the claims and the dependency references therein and irrespective of the description or depiction of said features in the drawings.

The figures in the drawings are schematic views of one possible embodiment of an electrical plug-in connector according to the invention.

The depictions in the drawings are therefore in particular not to scale, and therefore the scales selected in the drawings are different from one another. For better clarity, the depictions are reduced to the elements/components/parts that aid understanding.

In the drawings, the same or corresponding components/parts or elements are provided with the same reference numerals. For better clarity, however, not all elements/components/parts are always provided with reference numerals in the drawings; in this case, the numerals are assigned on the basis of the same depiction or a depiction that has been adapted to the view in question.

For better clarity, the description below will be reduced to the differences between the embodiments or figures if the structure is the same or similar.

As has already been mentioned above, the on the basis of the electrical plug-in connector according to the invention shown in the drawings also apply analogously to a printed circuit board according to the invention, and the drawings therefore also illustrate a printed circuit board of this kind having the features, properties and advantages of said electrical plug-in connector; however, the drawings focus on an electrical plug-in connector.

Furthermore, the invention is not limited to the described and shown embodiment of the invention that is used to illustrate said invention.

Figure 4:
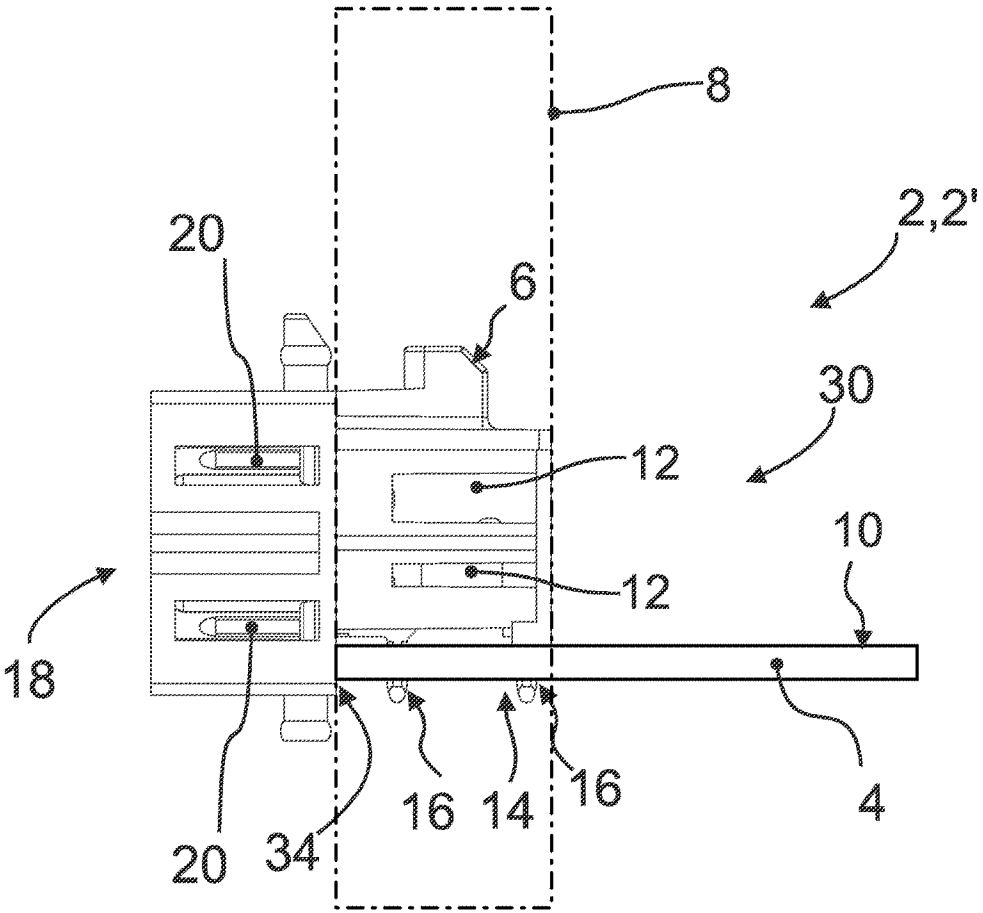
FIG. 4 is a schematic side view of the embodiment of an electrical plug-in connector according to the invention from FIG. 1 in the assembled state in which it is arranged on a printed circuit board for connection thereto.

FIG. 1 is a schematic, sectional side view of an embodiment of an electrical plug-in connector 2, which is provided for forming a printed circuit board connector 2' on a printed circuit board 4, as is shown in FIG. 4.

An electrical plug-in connector 2 will also be referred to below as a plug-in connector 2 for short.

The plug-in connector 2 is provided with a housing body 6, a housing portion 8 of which, in the embodiment shown, is arranged on an upper face 10 of the printed circuit board 4 in an assembled state shown in FIG. 4.

Furthermore, a plurality of electrical connector elements 12 (each being labeled with the same reference numeral) is accommodated in the housing body 4, each of which elements provides, on a printed circuit board contact side 14, a first contact portion 16 for electrically contacting the printed circuit board 4 and, on a plug-in connection side 18 that is at an angle to the printed circuit board contact side 14, a second contact portion 20 for electrically contacting a mating contact of a mating plug-in connector.

In the plug-in connector 2, the individual electrical connector element 12 is formed of a punched sheet-metal part and arranged on the housing body 6 such that the center of gravity 22 formed by the housing body 6, together with the electrical connector elements 12 accommodated therein, is within the housing portion 8.

This is achieved by the center of gravity 22 being formed of an overall center of gravity 22' that is formed by the plurality of electrical connector elements 12, and of a center of gravity 22" that is defined by the housing body 4; each of the centers of gravity 22, 22', 22" is represented by a circle symbol in FIG. 1.

The invention uses the formation of the resultant center of gravity 22 to advantageously fix the position thereof on the housing body 6—as described above—by means of the plurality of connector elements 12.

At the same time, the second contact portion 20 of the individual electrical connector element 12 projects beyond the housing portion 8 in portions such that part of the second contact portion 20 is arranged outside of the housing portion 8.

As is shown in FIG. 1, the housing portion 8 is the portion by means of which the plug-in connector 2 is arranged on the printed circuit board 4 in the assembled state (as is shown in FIG. 4), the housing portion 8 having a resting surface 24 which faces the printed circuit board 4 in the shown assembled state and on which the housing portion 8 rests on the printed circuit board 4.

In the plug-connector 2 shown, the first contact portion 16 and the second contact portion 20 of the individual electrical connector element 12 are each designed as a pin contact 16' 20' (each provided with the same reference numeral).

In addition, the first contact portion 16 and the second contact portion 20 of the individual electrical connector element 12 are interconnected by means of a sheet-like intermediate portion 26 that is larger than each of the second contact portion 20 and the first contact portion 16 in terms of area. In the embodiment shown, the sheet-like intermediate portion 26 defines the center of gravity of the individual electrical connector element 12 on account of the size ratios. The invention is not limited thereto, however. The design of the individual electrical connector elements 12 may be identical or different.

As can be seen in FIG. 1, the housing body is designed such that the electrical connector elements 12 are each inserted into the housing body 6 via a side opening 28, said elements being mutually spaced so as to be electrically disconnected from one another and, for this purpose, each being in a chamber 32 (universally labeled by reference numeral 32) associated with the individual electrical connector element 12.

To keep the plug-in connector 2 on the printed circuit board 4 and to securely electrically contact the individual first contact portion of the electrical connector element 12 in question, the first contact portion 16 of at least one of the plurality of electrical connector elements 12 is designed and formed for integral connection to the printed circuit board 4, said first contact portion being connected, in the connected state, to the printed circuit board 4 in an integral manner and, in this embodiment, by means of a soldered connection; as a result, the plug-in connector 2 is in turn securely connected to the printed circuit board 4.

Figure 2:
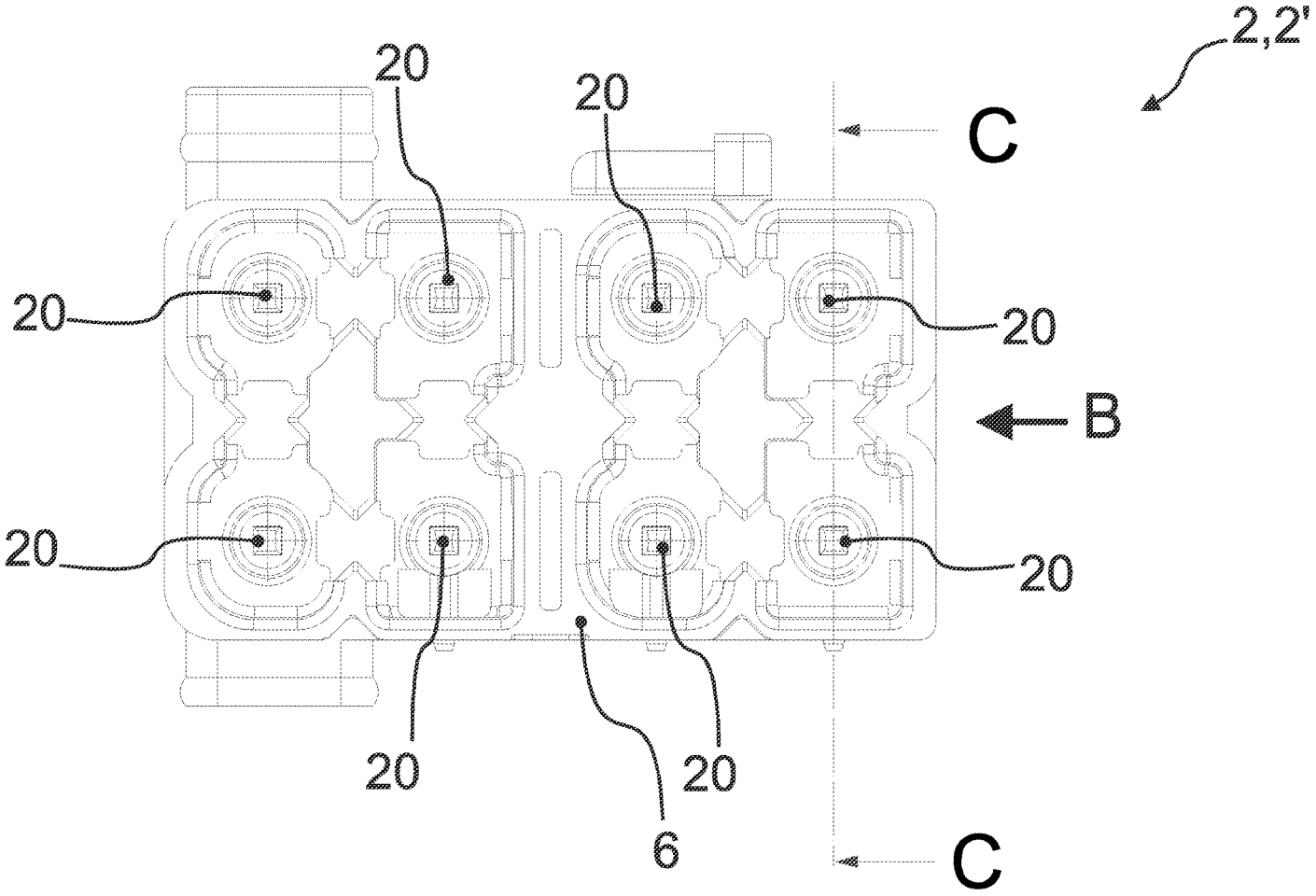
FIG. 2 shows the embodiment of an electrical plug-in connector according to the invention from FIG. 1 in a schematic view labeled as A in FIG. 1 and in a size ratio that is different to that in FIG. 1.
Figure 3:
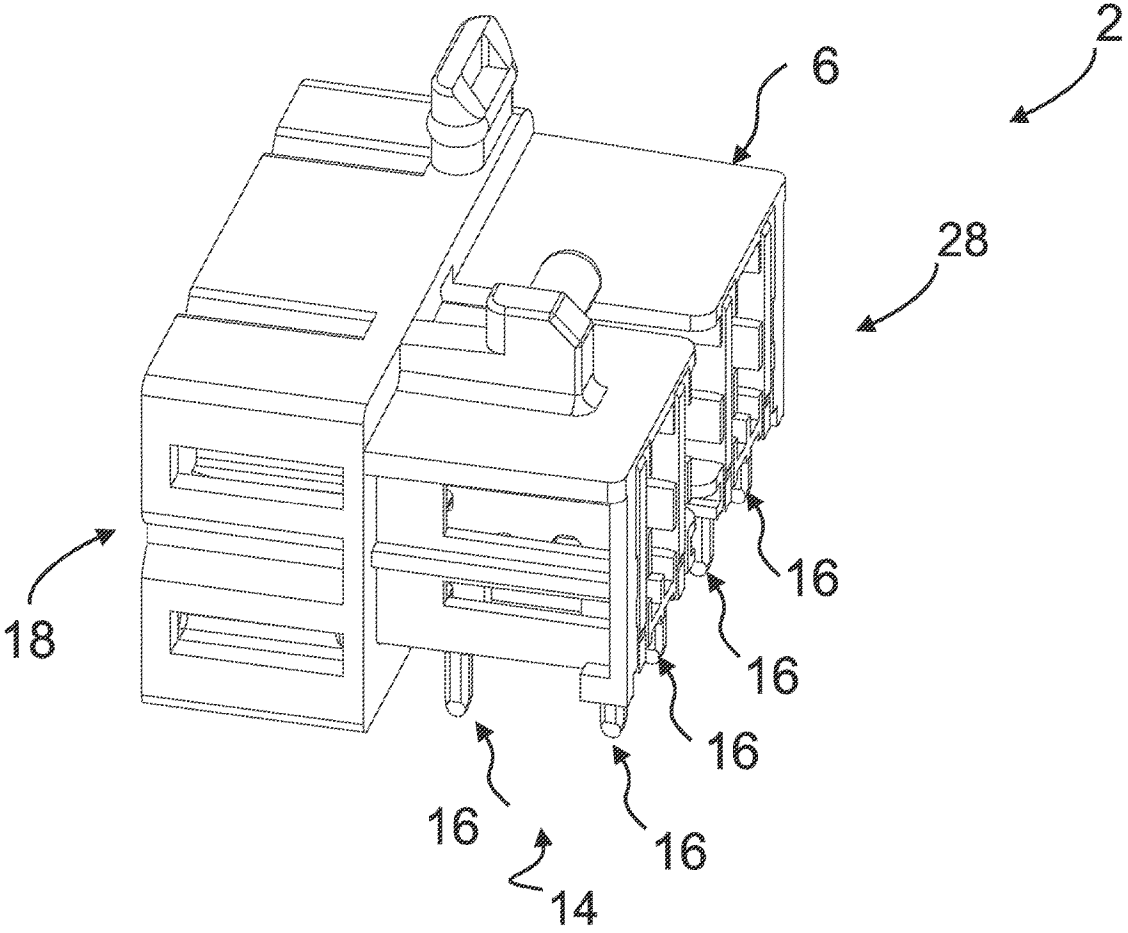
FIG. 3 is a schematic perspective view of the embodiment of an electrical plug-in connector according to the invention from FIG. 1.

FIG. 2 shows the embodiment from FIG. 1 in a view labeled as A in FIG. 1. It can be seen here that the plurality of electrical connector elements are arranged on the housing body 6 in a row-and-column arrangement in a manner mutually spaced, the individual second contact portions 20 also being arranged in this row-and-column arrangement in relation to one another.

FIG. 4 shows that, in the assembled state shown, the second contact portion 20 of the electrical connector element 12 projects in portions beyond an edge 34 of the printed circuit board 4 that is formed by the outer edge 34 of the printed circuit board 4.

FIG. 4 also shows an embodiment of a printed circuit board 4 according to the invention having a printed circuit board connector 2' that is formed by an electrical plug-in connector 2, as has already been described above and is shown in the drawings.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Electrical plug-in connector 2
Printed circuit board connector 2'
Printed circuit board 4
Housing body 6
Housing portion 8
Upper face 10
[of the printed circuit board 4]
Electrical connector element 12
Printed circuit board contact side 14
First contact portion 16
Plug-in connection side 18
Second contact portion 20
Resultant center of gravity 22
Center of gravity 22'
[of the plurality of electrical connector elements 12]
Center of gravity [of the housing body 6] 22"
Resting surface 24
Intermediate portion 26
Side opening 28
Chamber 32
Outer edge 34
[of the printed circuit board 30]

The invention claimed is:

1. An electrical plug-in connector for forming a printed circuit board connector on a printed circuit board, comprising:

a housing body which, when in use, overlaps a printed circuit board contact side on an upper face or lower face of the printed circuit board vis-à-vis a housing portion and comprises a plug-in connection side, configured for a mating plug-in connector, at an angle to the printed circuit board contact side; and an electrical connector element being accommodated in the housing body, which element provides, on the printed circuit board contact side, a first contact portion configured to contact a conducting track of the printed circuit board and, on the plug-in connection side, a second contact portion configured to contact a mating contact of the mating plug-in connector, wherein the connector element comprises a punched sheet-metal part such that a center of gravity of the electrical plug-in connector is arranged within the housing portion of the housing body due to the connector element being accommodated in the housing body.

2. The electrical plug-in connector according to claim 1, wherein the center of gravity of the connector element faces away from the second contact portion of the connector element.

3. The electrical plug-in connector according to claim 1, wherein the second contact portion of the connector element projects beyond the housing portion at least in portions.

4. The electrical plug-in connector according to claim 1, wherein, when in use, the second contact portion of the connector element projects beyond an outer edge of the printed circuit board at least in portions.

5. The electrical plug-in connector according to claim 1, wherein the connector element comprises a sheet.

6. The electrical plug-in connector according to claim 1, wherein the at least one connector element is inserted into the housing body via a side opening.

7. The electrical plug-in connector according to claim 1, wherein the first contact portion of the at least one connector element is integrally connected to the conducting track of the printed circuit board.

8. The electrical plug-in connector according to claim 1, further comprising a plurality of connector elements accommodated in the housing body, an overall center of gravity of the plurality of connector elements being arranged within the housing portion.

9. The electrical plug-in connector according to claim 8, wherein the connector elements of the plurality of connector elements are arranged on the housing body in a row-and-column arrangement in a mutually spaced manner.

10. The electrical plug-in connector according to claim 1, wherein the electrical plug-in connector comprises an SMD component.

11. A printed circuit board, comprising:

a printed circuit board connector arranged thereon, wherein printed circuit board connector comprises the electrical plug-in connector according to claim 1.

12. The electrical plug-in connector according to claim 2, wherein the center of gravity of the connector element faces the first contact portion of the connector element.

13. The electrical plug-in connector according to claim 7, wherein the first contact portion of the at least one connector element is integrally connected to the conducting track of the printed circuit board by a soldered connection.

* * * * *